US006904946B2

(12) United States Patent
James

(10) Patent No.: US 6,904,946 B2
(45) Date of Patent: Jun. 14, 2005

(54) APPARATUS AND METHOD FOR BAGGING ICE

(76) Inventor: Charles James, 458 Cove Dr., Marietta, GA (US) 30067

( * ) Notice: Subject to any disclaimer, the term of this patent is extended or adjusted under 35 U.S.C. 154(b) by 73 days.

(21) Appl. No.: 10/288,146

(22) Filed: Nov. 5, 2002

(65) Prior Publication Data

US 2004/0084106 A1 May 6, 2004

(51) Int. Cl.[7] ..... B65B 43/00

(52) U.S. Cl. ..... 141/313; 141/82; 141/114; 222/146.6; 53/459; 62/344

(58) Field of Search ..... 141/10, 82, 114, 141/313–317; 222/146.6; 62/331, 60, 340, 344; 53/167, 384.1, 452, 459, 467, 468, 503, 573

(56) References Cited

U.S. PATENT DOCUMENTS

| | | | | |
|---|---|---|---|---|
| 3,712,019 | A | | 1/1973 | Lamka et al. |
| 3,789,570 | A | | 2/1974 | Mullins, Jr. |
| 3,807,193 | A | | 4/1974 | McKenney et al. |
| 3,913,343 | A | | 10/1975 | Rowland et al. |
| 3,918,266 | A | | 11/1975 | Gindy et al. |
| 4,132,049 | A | | 1/1979 | Mullins, Jr. |
| 4,139,029 | A | | 2/1979 | Geraci |
| 4,348,872 | A | | 9/1982 | Hill |
| 4,368,608 | A | | 1/1983 | Ray |
| 4,404,817 | A | | 9/1983 | Cox, III |
| 4,612,779 | A | | 9/1986 | Hatton |
| 4,689,937 | A | * | 9/1987 | Finan et al. ..... 53/502 |
| 5,088,300 | A | | 2/1992 | Wessa |
| 5,109,651 | A | | 5/1992 | Stuart |
| 5,211,030 | A | | 5/1993 | Jameson |
| 5,277,016 | A | | 1/1994 | Williams |
| 5,458,851 | A | | 10/1995 | Schroeder et al. |
| 5,473,865 | A | | 12/1995 | Tanaka et al. |
| 5,581,982 | A | | 12/1996 | Schroeder et al. |
| 5,630,310 | A | | 5/1997 | Chadwell |
| D407,092 | S | | 3/1999 | Weaver |
| 5,887,758 | A | | 3/1999 | Hawkes et al. |
| 6,112,539 | A | | 9/2000 | Colberg |
| 6,266,945 | B1 | | 7/2001 | Schroeder |
| 6,354,338 | B1 | | 3/2002 | Takemoto |

* cited by examiner

*Primary Examiner*—J. Casimer Jacyna
(74) *Attorney, Agent, or Firm*—Myers & Kaplan, LLC; Ashish D. Patel; Joel D. Myers

(57) ABSTRACT

An ice-bagging apparatus that provides an establishment with the ability to automatically and expeditiously produce, bag and store bags of ice, thus maintaining a desired supply of bagged ice and eliminating conventional methods of manual ice-bagging and reducing the likelihood of unwanted bridging of the ice.

43 Claims, 8 Drawing Sheets

APPARATUS AND METHOD FOR BAGGING ICE

TECHNICAL FIELD

The present invention relates generally to ice machines, and more specifically to an ice-bagging apparatus and method thereof. The present invention is particularly suitable for, although not strictly limited to, automatically bagging ice for the continuous supply thereof.

BACKGROUND OF THE INVENTION

Bagged ice may be found in most grocery stores, convenience stores, gas stations and/or superstores. These bags are typically stored in freezers on the premises of such locations. A concern for most vendors of these establishments is the necessity of maintaining an adequate supply of bagged ice for their customers. Unfortunately, most establishments are not equipped with ice-making and bagging facilities or machinery and are thus forced to rely on shipments of bagged ice and consequently accept the potential delay thereof, thus adversely affecting the establishment's customer satisfaction and profit margin.

Although some establishments may be equipped with ice-making machinery, most are typically not equipped with efficient and automated ice-bagging machinery. Instead, such establishments often have on-site employees manually fill individual bags with ice and then load the individual bags into a freezer, thus resulting in a highly inefficient and potentially unsanitary process. Furthermore, bags manually filled with ice are generally not immediately placed within a freezer to maintain solid state of the ice, but are instead allowed to sit for a period of time on the floor or in a basket or container where bridging/fusing of the ice results as a consequence of the ice melting. As such, a customer purchasing manually filled bags of ice is often burdened with having to break a large clump or block of ice into useable pieces. Bags of ice shipped or trucked to a grocery store are also subject to bridging during transport of the ice bags from the delivery truck to inside the store and then into the store's freezers.

Facilities that possess presently available ice making, bagging and storing machine are still at a disadvantage, as the technology of prior-art machines has generally remained inefficient, thereby adversely affecting profitability. In particular, most prior-art machines require augers to channel and physically transport ice produced by the icemaker to a reservoir for subsequent bagging. As such augers are typically slow in transporting the ice to the reservoir and fail to incorporate drainage mechanisms to assist in the channeling away of melting ice, unwanted bridging/fusing of ice particles results, and as such, utilization and incorporation of such augers is disadvantageous. Furthermore, because such machinery may bag ice based on weight of the collected ice within the reservoir, fused clumps of ice are often deposited into the bags when the required weight of ice, clumped or not, has been met. Consequently, the slow speed and inefficiency of machinery incorporating such augers directly impacts the number of bags of ice that can be produced and, as such, has a direct and negative impact on sales volume and profit of the establishment utilizing the machinery.

Moreover, prior-art ice making, bagging and storing machines that incorporate hoppers for receipt of ice from the icemaker, typically do not possess an agitator in the hopper to assist in breaking up and/or agitating the ice particles/cubes so as to prevent bridging. As a result, bags of ice yielded from these prior art machines generally contain fused clumps of ice particles/cubes, thereby inconveniencing the purchaser/customer by requiring him/her to break apart the chunks of ice into smaller useable pieces.

Therefore, it is readily apparent that there is a need for an ice-bagging apparatus that provides an establishment with the ability to automatically and continuously produce, bag and store bags of non-bridged ice without the need of manual labor and/or continuous monitoring of the machinery.

BRIEF SUMMARY OF THE INVENTION

Briefly described, in a preferred embodiment, the present invention overcomes the above-mentioned disadvantages and meets the recognized need for such a device by providing an ice-bagging apparatus and method that provides an establishment with the ability to automatically and expeditiously produce, bag and store bags of ice, thus maintaining a desired supply of bagged ice by eliminating conventional methods of manual ice bagging and reducing the likelihood of unwanted bridging of the ice particles/cubes.

According to its major aspects and broadly stated, the present invention in its preferred form is an ice-bagging apparatus having an icemaker, a hopper for receiving ice from the icemaker, a slider box for receiving ice from the hopper and for channeling the ice into a bag, a bagging mechanism for bagging the ice, a freezer for storing the bagged ice and a control panel for managing and monitoring said system.

More specifically, the present invention is an ice bagging apparatus having an icemaker, a hopper for receiving ice from the icemaker, a slider box positioned under the hopper for receiving ice therefrom and for channeling the ice into a bag, wherein the bag is fed through the apparatus via a bag supply mechanism. Once filled with a desired amount of ice, the slider box slides/travels along a slider tray and is preferably computer programmed/electronically controlled to position itself over the bag, wherein ice is subsequently deposited therein. Prior to filling, the mouth of the bag is preferably blown open via a blower/fan and manually/physically held open via a pivoting hatch positioned just over the bag. The filled bag is then heat sealed via heat sealers and then dropped into a rotator, wherein motors rotate the rotator, allowing the bag to drop into a freezer/storage unit. The entire process is preferably fully automated and/or computer controlled, such that the speed of the machine can be altered according to the desired production rate of bagged ice. The apparatus further possesses laser eyes positioned at specified points on the apparatus for reading the process of the apparatus at various stages, so as to ensure proper functioning therefore. Additional certain laser eyes are provided to read a bar code or other signal/code on the bag, thus ensuring use of only a select type/brand of bag.

Should the apparatus encounter a problem, the apparatus will attempt to correct the malfunction via computer preprogramed responses implemented within the control panel. If the apparatus is unable to correct the malfunction, the control panel sends signals via modem or other communication devices to the manufacture of the apparatus for repair and/or to store management depending upon the complexity of the problem. Additionally, data can be collected and analyzed regarding the volume of sales based on the number of bags utilized, the number of cycles or the volume of ice produced.

A feature and advantage of the present invention is its ability to continuously and automatically produce bags of ice, thus constantly maintaining a desired supply of bags of ice.

A feature and advantage of the present invention is its ability to send and receive computer signals for regular maintenance and/or reporting.

A feature and advantage of the present invention is its ability to drain water so as to reduce the likelihood of bridging/fusing of ice particles during the ice making and bagging processes.

A feature and advantage of the present invention is its ability to function without the incorporation of augers as utilized in prior-art machines, thus reducing the likelihood of bridging of the ice.

A feature and advantage of the present invention is its ability to permit and police the selection of a particular type/brand of bag.

A feature and advantage of the present invention is its reduced size as compared to prior-art machines, thus reducing the necessary footprint and consequently the costs of floor space.

A feature and advantage of the present invention is its ability to manually/mechanically hold open a bag during the process of filling the bag with ice.

A feature and advantage of the present invention is its ability to agitate the ice held within the hopper, thus reducing the likelihood of bridging of the ice.

A feature and advantage of the present invention is its ability to function without the use of an auger as utilized in prior art machines, thus enabling increased production rates.

A feature and advantage of the present invention is its ability to reduce the vendor's overall cost of bagged ice.

A feature and advantage of the present invention is its ability to correct and/or attempt to correct problems associated with its components and/or machine parts, wherein problems that require further investigation/repair are reported via a modem and/or global networking system to a repair/servicing company or the like.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND CERTAIN ALTERNATIVE EMBODIMENTS

In describing the preferred embodiments of the present invention, as illustrated in FIGS. 1–8, and certain alternate embodiments of the present invention, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
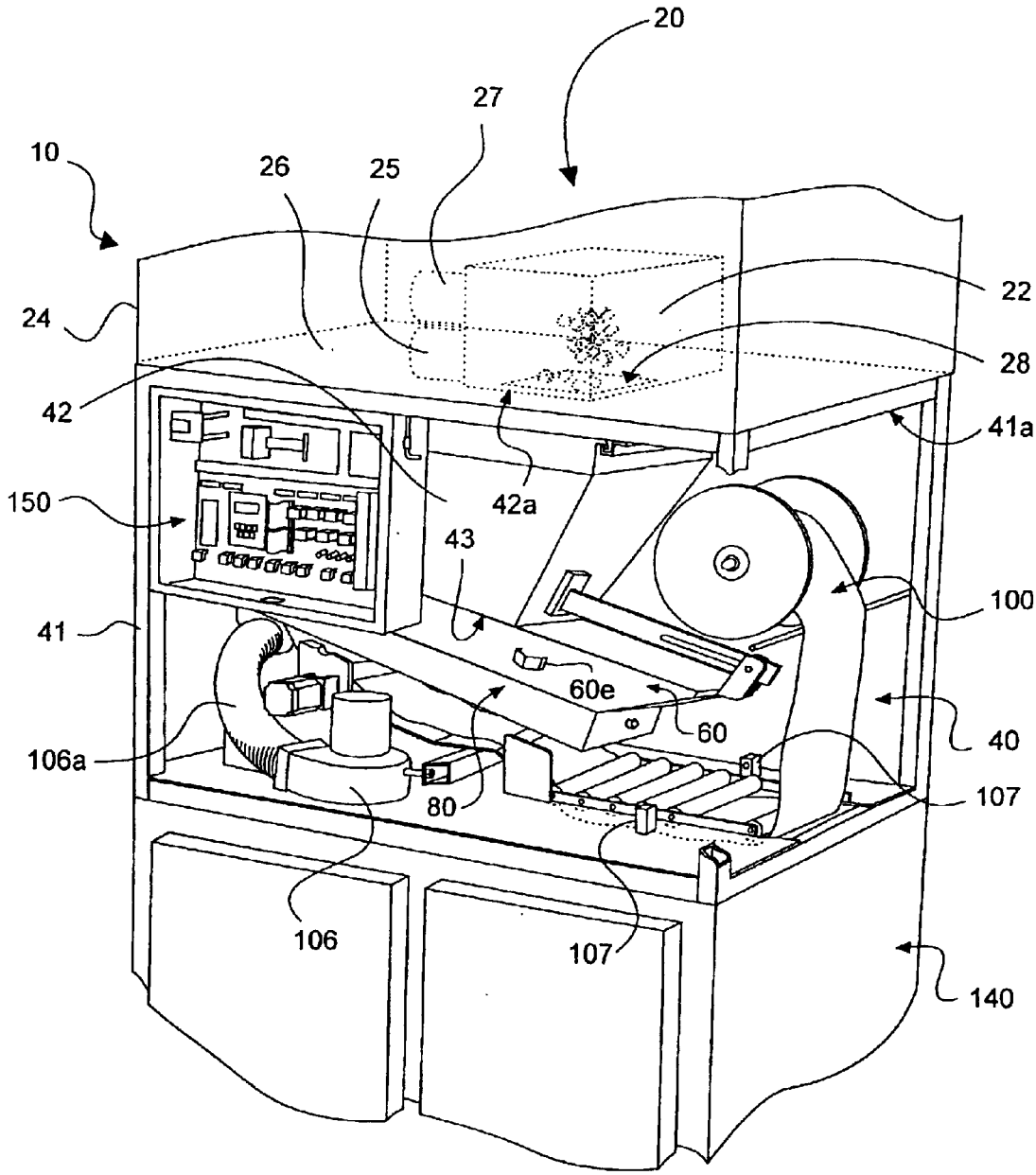
FIG. 1 is a front perspective view of an ice-bagging apparatus according to a preferred embodiment of the present invention.

Referring now to FIG. 1, the present invention in a preferred embodiment is an apparatus 10, wherein apparatus 10 is an ice-bagging apparatus having, in general, icemaker assembly 20, bagging assembly 40, storage 140 and control panel 150. Preferably, icemaker assembly 20 is positioned on and above bagging assembly 40, and bagging assembly 40 is preferably positioned on and above storage 140. Bagging assembly 40 further preferably possesses control panel 150 secured thereto, wherein control panel 150 is preferably in computer/electronic communication with apparatus 10 in general, as more fully described below. One skilled in the art would readily recognize that control panel 150 could be positioned in any location on or near apparatus 10, wherein user accessibility and functional communication between necessary components is facilitated. Moreover, while the generally "stacked" arrangement is preferred, the relative positions of icemaker assembly 20, bagging assembly 40 and storage 140 could be alternatively configured, wherein alternate and/or additional means of ice transport therebetween could be incorporated or one unit housing incorporating icemaker assembly 20, bagging assembly 40 and storage 140 could be utilized, wherein individual housings and apertures therebetween could be modified and/or eliminated.

Icemaker assembly 20 is preferably a conventional icemaker as known within the art, possessing icemaker 22 enclosed within housing 24, wherein bottom wall 26 of housing 24 preferably possesses aperture 28, and wherein aperture 28 is preferably aligned with hopper 42 of bagging assembly 40 so as to permit ice produced by icemaker 22 to enter through aperture 28 for receipt by hopper 42, as more fully described below. To ensure the highest quality of ice produced via icemaker 22, sediment filter 25 and UV filter 27 are preferably disposed within icemaker assembly 20 and/or in line with the water source to preferably filter the water prior to the production of ice therefrom.

Figure 2:
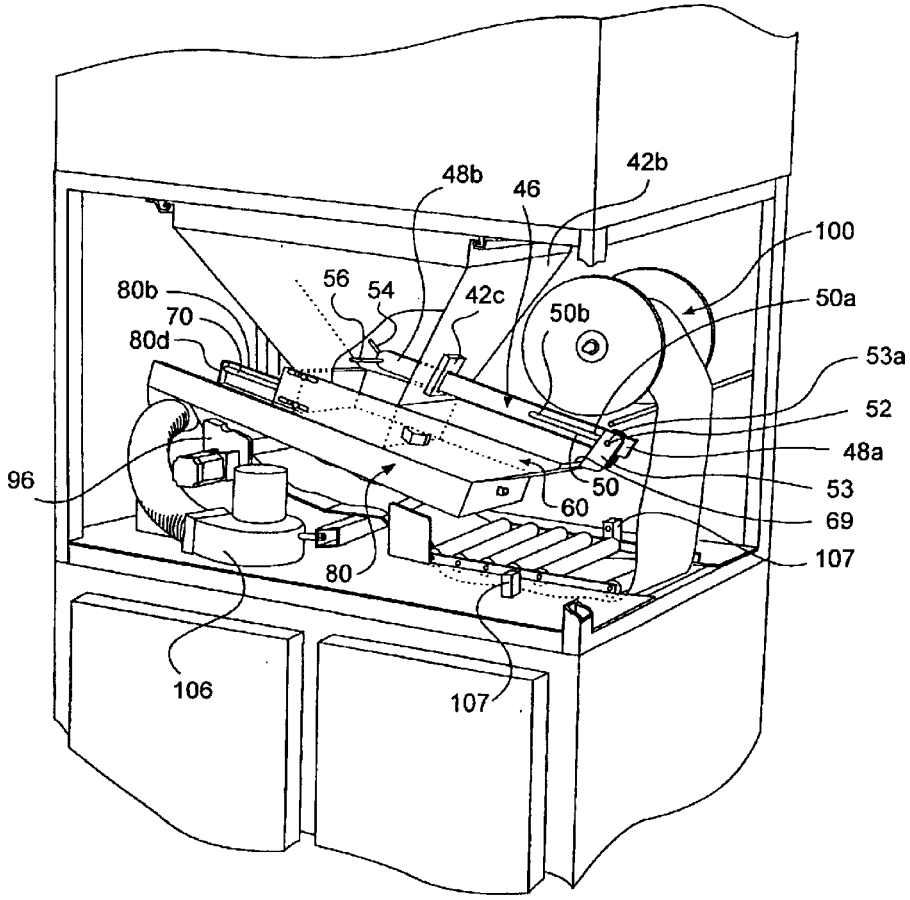
FIG. 2 is a front perspective view of an ice-bagging apparatus according to a preferred embodiment of the present invention.
Figure 3:
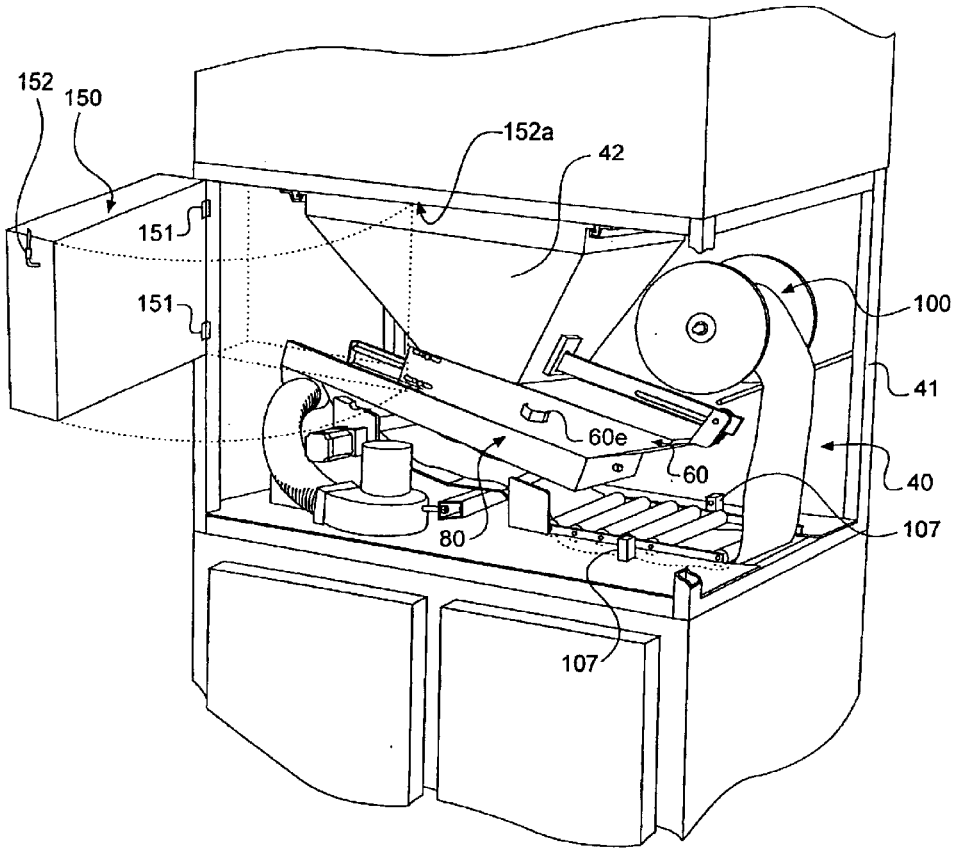
FIG. 3 is a front perspective view of an ice-bagging apparatus according to a preferred embodiment of the present invention.
Figure 4:
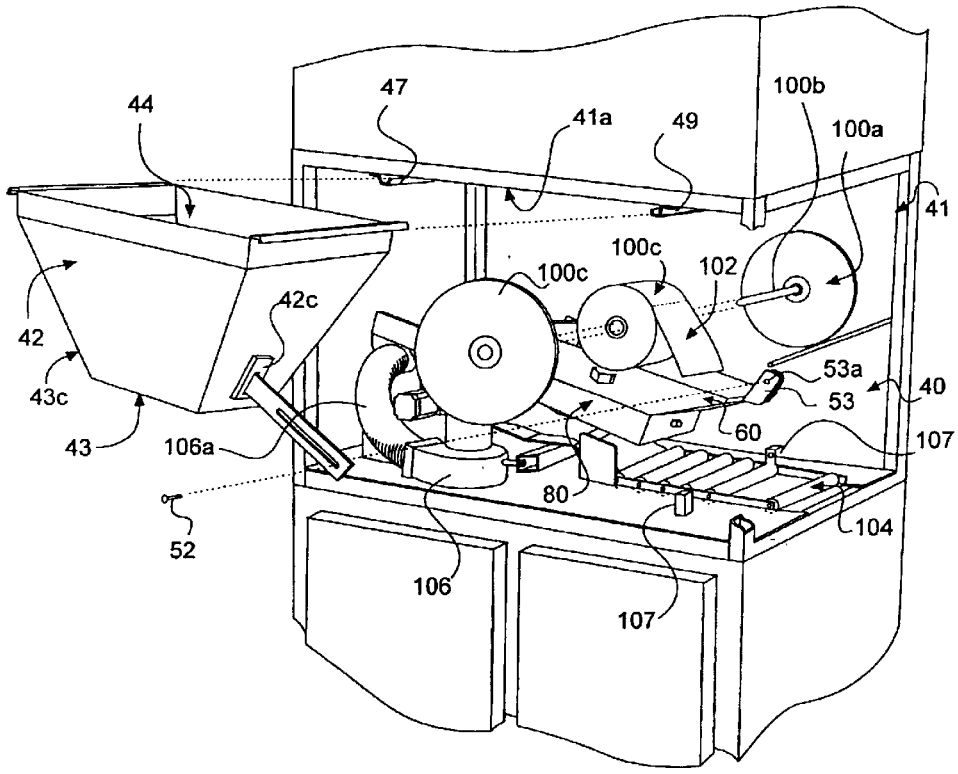
FIG. 4 is a front perspective view of an ice-bagging apparatus according to a preferred embodiment of the present invention.

Referring now to FIGS. 2–4, bagging assembly 40 is preferably enclosed within a substantially rectangular housing 41, wherein upper wall 41*a* of housing 41 possesses an aperture 42*a* positioned over and aligned with mouth 44 of hopper 42, and wherein hopper 42 is preferably inverted-pyramidal-shaped to facilitate the funneling therein of ice cubes/particles produced by icemaker 22. Aperture 42*a* is further preferably aligned with aperture 28 of icemaker assembly 20, wherein ice produced by icemaker 22 preferably falls through aperture 28 of icemaker assembly 20, through aperture 42*a* of housing 41 of bagging assembly 40, and then into mouth 44 of hopper 42. Once hopper 42 is filled with a desired amount of ice as dictated by control panel 150, ice collected within hopper 42 is preferably channeled into slider box 60 through aperture 43 of hopper 42, wherein slider box 60 is positioned directly beneath hopper 42, as more fully described below.

Hopper 42 preferably possesses agitator 46, wherein agitator 46 preferably possesses a generally elongated-rectangular-shaped arm 48 having first end 48*a* and second end 48*b*, wherein arm 48 is preferably slidably engaged with slot 42*c* formed through wall 42*b* of hopper 42.

Preferably formed through arm 48 is slot 50 preferably having first end 50*a* and second end 50*b*, wherein first end 50*a* is preferably positioned proximal first end 48*a* of arm 48, and wherein second end 50*b* is preferably positioned proximal second end 48*b* of arm 48. Preferably, pin 52 extends through throughhole 53*a* of prong-shaped support bracket 53, wherein support bracket 53 is preferably formed on edge 69 of slider box 60, and wherein pin 52 thereafter preferably extends through slot 50 and is slidably engaged therewith, as best depicted in FIG. 2.

Preferably formed at second end 48*b* of arm 48 of agitator 46, and angled outwardly therefrom, are prongs 54 and 56, wherein prongs 54 and 56 preferably assist in the agitation of ice within hopper 42 upon the movement of arm 48 through slot 42*c* of hopper 42. Specifically, upon movement of slider box 60 over slider tray 80 (for purposes more fully described below), pin 52 of arm 48 of agitator 46 preferably leaves first end 50*a* of slot 50 of arm 48 and slides through the length of slot 50 until pin 52 contacts second end 50*b* of slot 50, whereupon pin 52 pushes arm 48 through slot 42*c* of hopper 42, thus agitating ice collected therein via prongs 54 and 56 of arm 48, thereby reducing/eliminating the occurrence of bridging between the ice. While arm 48 and prongs 54 and 56 are preferably utilized to agitate ice collected in hopper 42, one skilled in the art with the benefit of the present disclosure, would readily recognize that other shapes, agitation means and/or mechanisms could be utilized to perform substantially the same function without departing from the intended scope of the present invention.

Referring now more specifically to FIGS. 3–4, control panel 150 is preferably hingably connected to housing 41 of bagging assembly 40 via hinges 151, wherein removal of spring-loaded pin 152 of control panel 150 from lock-hole 152 formed on housing 41 of bagging assembly 40 preferably exposes hopper 42, thus permitting the removal of hopper 42 from housing 41 via slidably removing hopper 42 from support rails 47 and 49 positioned on and secured to upper wall 41*a* of housing 41. To facilitate removal of hopper 42 from housing 41, pin 52 of arm 48 of agitator 46 is preferably removed from throughhole 53*a* of support bracket 53 of slider box 60, thus permitting arm 48 to unlatch therefrom. Once removed from housing 41, hopper 42 can then be sanitized and/or cleaned as desired, thus further maintaining the sterility of ice deposited therein.

Figure 5:
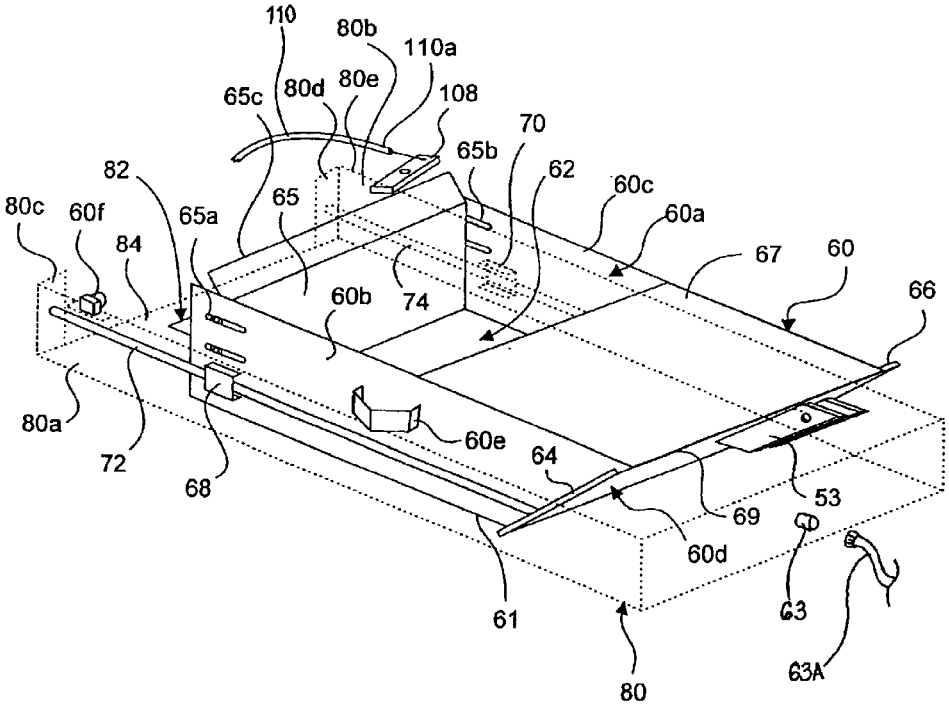
FIG. 5 is a perspective view of the slider box of an ice-bagging apparatus according to a preferred embodiment of the present invention.

Referring now to FIG. 5, slider box 60 preferably possesses a generally trapezoidal-shape and preferably has an aperture 62 formed through front area 60*a* of slider box 60, wherein slider tray 80 positioned under slider box 60 preferably serves as a bottom or closure means for aperture 62, thus permitting slider box 60 to maintain ice received from hopper 42 therein. To increase the overall volumetric capacity of aperture 62 of slider box 60, front wall 65 of slider box 60 is preferably slidably adjustable via slot-and-bolt mechanisms 65*a* and 65*b* formed on side walls 60*b* and 60*c*, respectively, of slider box 60 and in communication with front wall 65, wherein front wall 65 is preferably adjustable to enable aperture 62 to receive 5 lbs, 10 lbs and/or 20 lbs of ice therein for the subsequent generation of 5 lbs, 10 lbs and/or 20 lbs bags of ice, respectively. Furthermore, front wall 65 preferably possesses upwardly angled lip 65*c* formed thereon, wherein angled lip 65*c* preferably abuts front edge 43*c* of aperture 43 of hopper 42 when slider box 60 is in a resting position, thus shunting the flow of any vestigial ice particles from aperture 43 of hopper 42 (see FIGS. 7–8). Although aperture 62 of slider box 60 is capable of receiving 5 lbs, 10 lbs and/or 20 lbs of ice, it is contemplated in an alternate embodiment that aperture 62 and/or front wall 65 could be modified to receive any desired quantity of ice. Slider box 60 is preferably formed from a metal material, although other suitable materials may be utilized, such as, for exemplary purposes only, plastic.

Formed preferably along side walls 60*b* and 60*c* of slider box 60, proximal to angled region 60*d* of bottom wall 61 of slider box 60, are channels 64 and 66, respectively, wherein channels 64 and 66 preferably function to divert water and/or slurry from the ice held within aperture 62 of slider box 60 and on slider tray 80, as more fully described below. Additionally, formed preferably on sides 60*b* and 60*c* of slider box 60 are rail engagers 68 and 70, respectively, that preferably slidably engage rails 72 and 74 positioned along side walls 80*a* and 80*b*, respectively, of slider tray 80, and ending in secured contact with front walls 80*c* and 80*d*, respectively of slider tray 80. Rail engagers 68 and 70 of slider box 60 and respective rails 72 and 74 of slider tray 80 preferably permit slider box 60 to travel along slider tray 80 via assistance from motor 89 (not shown) positioned under slider tray 80, thus permitting slider box 60 to deposit ice into bag 102, as more fully described below. Furthermore, to ensure that slider box 60 slides the appropriate distance over, slider tray 80, slider box 60 preferably possesses trip bar 60*e* formed on side wall 60*b* of slider box 60, wherein trip bar 60*e* preferably contacts and trips switch 60*f* positioned proximal slider tray 80 and in computer communication with control panel 150 (see FIG. 5), and wherein the tripping of switch 60*f* by trip bar 60*e* preferably halts further movement of slider box 60 over slider tray 80.

Slider tray 80 is preferably substantially rectangular-shaped and is preferably formed from a metal material, although other suitable materials may be utilized, such as, for exemplary purposes only, plastic. Preferably, aperture 82 is formed through bottom wall 84 of slider tray 80, wherein computer activated/automated movement of slider box 60 along rails 72 and 74 preferably results in aperture 62 of slider box 60 being aligned with and positioned over aperture 82 of slider tray 80, such that ice collected and retained within slider box 60 is thereafter deposited through aperture 62 of slider box 60 and then through aperture 82 of slider tray 80 for subsequent receipt by bag 102, as more fully described below. Furthermore, when slider box 60 slides over slider tray 80, flat upper surface 67 of slider box 60, proximal aperture 62 of front area 60*a*, preferably becomes positioned under aperture 43 of hopper 42, thus shunting and/or stopping any further ice from exiting aperture 43 of hopper 42.

Preferably, slider tray 80 is positioned on mount 96, wherein mount 96 is preferably ramp-like so that slider tray 80 and supported slider box 60 are preferably upwardly slanted and/or angled relative to storage 140. Such preferred slanting/angling of slider tray 80 and supported slider box 60 gravitationally encourages liquid and/or slurry formed within and on slider box 60 to travel downwardly and away from the ice held within aperture 62 of slider box 60 and on slider tray 80, wherein such water and/or melting ice is preferably diverted through and down channels 64 and 66 of slider box 60 and into slider tray 80, whereupon water may be drained therefrom via drainage spout 63 formed on slider tray 80 via assistance from attached hose 63A. This preferred configuration reduces the likelihood of bridging/fusing of the ice cubes held within aperture 62 due to excess water and/or melting ice.

Figure 6:
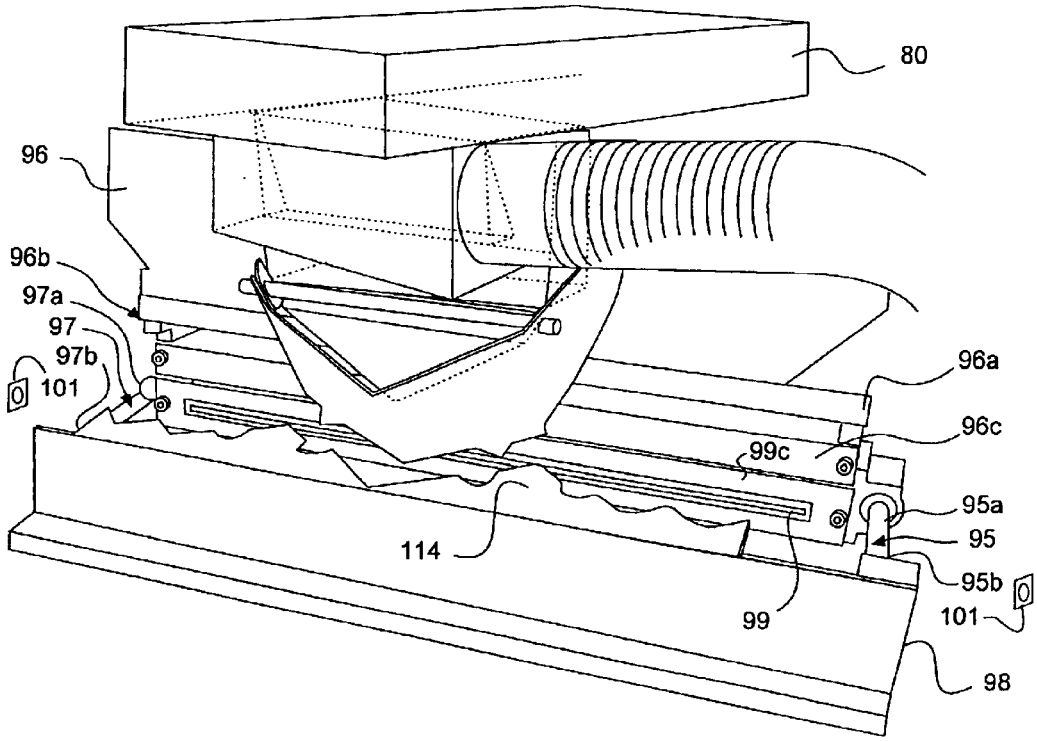
FIG. 6 is a perspective view of the hatch and heat seal pad of an ice-bagging apparatus according to a preferred embodiment of the present invention.
Figure 7:
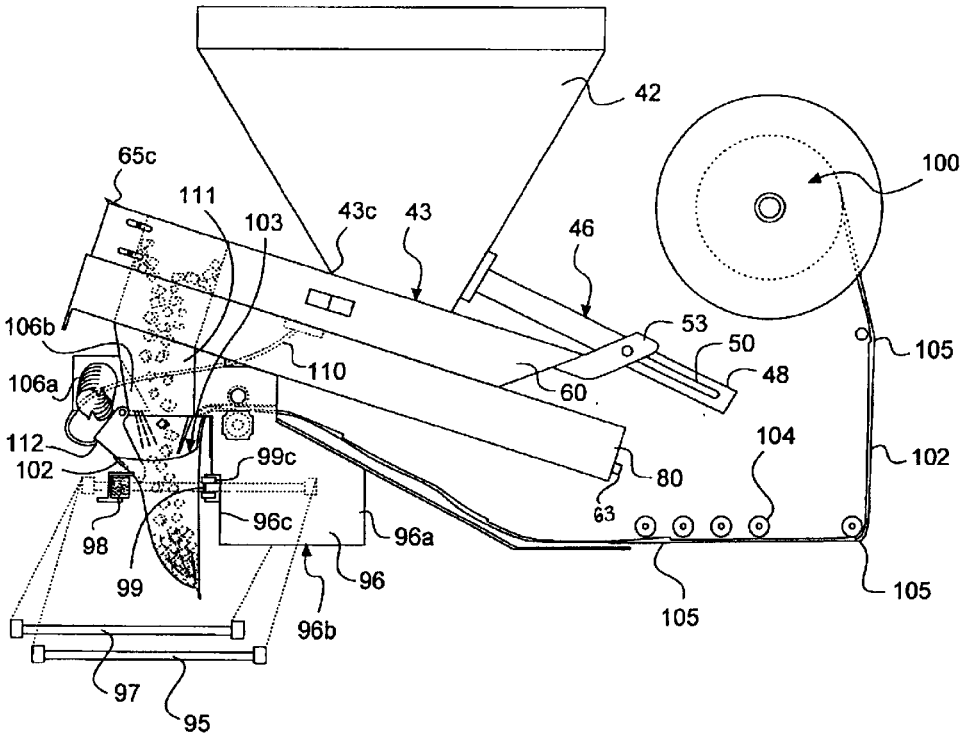
FIG. 7 is a side view of the bagging assembly of an ice-bagging apparatus according to a preferred embodiment of the present invention.
Figure 8:
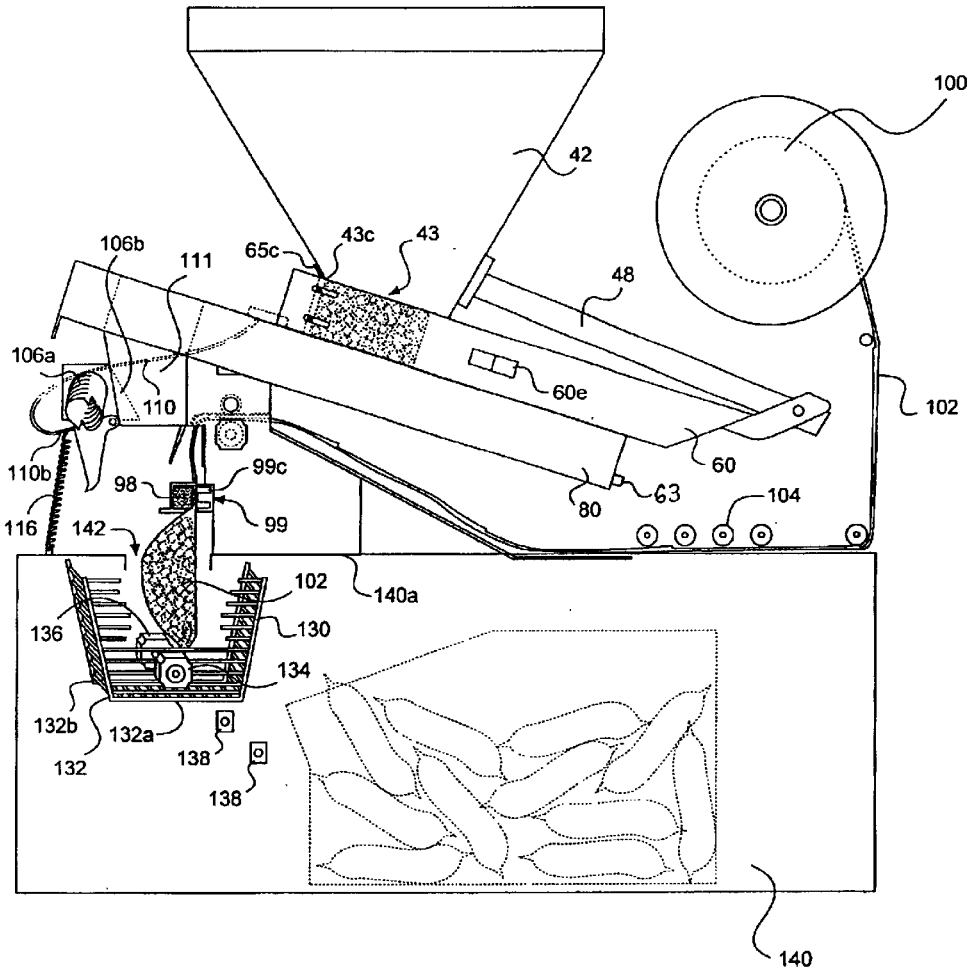
FIG. 8 is a side view of the bagging assembly and the storage of an ice-bagging apparatus according to a preferred embodiment of the present invention.

Referring now to FIGS. 6–8, secured preferably to sides 96*a* and 96*b* of mount 96 are ends 95*a* and 97*a*, respectively, of rails 95 and 97, respectively, wherein opposing ends 95*b* and 97*b*, respectively, are preferably in communication with heat seal pad 98, and wherein heat seal pad 98 is preferably any suitable heat seal pad as known within the art. Formed preferably on front face 96*c* of mount 96 is heat seal strip 99, wherein computer activated sliding of heat seal pad 98 along rails 95 and 97 preferably enables contact of heat seal pad 98 with heat seal strip 99, thus heat sealing the top portion of an ice-filled bag 102 positioned therebetween, as more fully described below. Furthermore, to prevent a heat-sealed bag of ice 102 from sticking to heat seal strip 99, spring-loaded kick-bar 99*c* positioned preferably over and around heat seal strip 99 preferably springfully kicks forward, thus pushing the heat-sealed bag of ice 102 off heat sealer 99, wherein kick-bar 99*c* is preferably initially pushed inward upon initial heat sealing of bag 102. Heat seal pad 98 is preferably positioned beneath bottom wall 84 of slider tray 80 so as to prevent heat seal pad 98 from interfering with the passage of ice from aperture 82 of slider tray 80 into bag 102 positioned thereunder.

Bag roll 100, preferably positioned behind angled region 60*d* of slider box 60, preferably supplies bags 102 for the filling of ice therein, wherein bags 102 are preferably joined and separable via perforations 105 formed between each bag 102. Preferably, only one side of bag 102 is attached to a preceding bag 102, wherein the unattached or opposing side of bag 102 is preferably freely openable so as to expose mouth 103 of bag 102 for the placement of ice therein and therethrough. As best illustrated in FIG. 4, bag roll 100 is preferably supported in housing 41 of bagging assembly 40 via spool-mechanism 100*a*. Preferably, upon exhaustion of bags 102 from bag roll 100, spool-mechanism 100*a* preferably permits a new bag roll 100 to be placed on spool pin 100*b* via removal of spool plate 100*c* from spool pin 100*b*.

Specifically, bags 102 are preferably conveyed over roller assembly 104, wherein roller assembly 104 is preferably positioned substantially beneath slider tray 80. Bags 102 traveling over roller assembly 104 are preferably transported through bagging assembly 40 and an individual bag 102 is preferably halted under aperture 82 of slider tray 80, and preferably over rotator 130 for subsequent receipt of a filled bag of ice 102 therein, as more fully described below. Upon bringing a bag 102 to a halt under aperture 82, blower 106 preferably blows open bag 102 via tube 106*a* and blower vent 106*b*, thus exposing mouth 103 for the placement of ice therethrough and therein, wherein blower 106 is preferably a conventional fan blower as known within the art, and wherein blower vent 106*b* is preferably positioned within chute 111 and over bag 102, as more fully described below. Following the blowing open of bag 102, control panel 150 preferably computer activates slider box 60 to slide up slider tray 80 via rails 72 and 74, resulting in aperture 62 of slider box 60 aligning with and positioning over aperture 82 of slider tray 80, such that ice collected and retained within slider box 60 is thereafter deposited through aperture 62 of slider box 60, through aperture 82 of slider tray 80, through chute 111 aligned therewith, and then through mouth 103 of bag 102 for the collection of the ice therein. To enable selection of a specific make, brand and/or type of bag 102, laser eyes 107 preferably read barcodes and color of bag 102 and/or other signals/codes thereon as bags 102 are fed through bagging assembly 40, wherein utilization of improper bags preferably permits laser eyes 107 to halt operation of bagging assembly 40, and apparatus 10 in general, via communication with control panel 150. Laser eyes 107 also preferably function to detect operational and/or mechanical maintenance requirements associated with bag 102 and/or bag roll 100, wherein such maintenance may include detecting when bag roll 100 is on its last bag 102, and/or detecting strands of adhesive tape typically utilized to connect one bag roll 100 to another bag roll 100. Laser eyes 107 preferably flank roller assembly 104, as best illustrated in FIGS. 1–4. Although laser eyes 107 are preferred, any comparable assessment and/or data collection means could be utilized such as, for exemplary purposes only, infrared or ultraviolet or other scanning means.

Referring back to FIG. 5, preferably, lever 108 is positioned on and in pivotal communication with edge 80*e* of sidewall 80*b* of slider tray 80, and just forward of front wall 65 of slider box 60. Attached to lever 108 is end 110*a* of cable 110, wherein pivotation of lever 108 preferably causes the subsequent tensioning of attached cable 110. End 110*b* of cable 110 is preferably attached to shovelhead-shaped hatch 112, wherein hatch 112 is preferably positioned proximate to aperture 82 of slider tray 80, and proximate to mouth 103 of bag 102, and wherein hatch 112 preferably functions as a gate over bag 102, permitting ice to be loaded therein only when hatch 112 is opened. Preferably, tensioning of cable 110 causes hatch 112 to flip downward relative to slider tray 80 and manually hold open bag 102, thus widening mouth 103 of bag 102 and facilitating the filling of ice therethrough and therein, wherein hatch 112 further functions as a slide, channeling ice passing thereagainst through mouth 103 and into bag 102. Halting and filling of bag 102 is further preferably accurately guided/controlled via laser eyes 101 that preferably flank heat seal pad 98, as best illustrated in FIG. 6. Laser eyes 101 are preferred for guidance and control, however one skilled in the art would readily recognize that other means for sensory guidance and control could be utilized such as, for exemplary purposes only, infrared and ultraviolet mechanisms.

Upon completion of filling bag 102 with ice, slider box 60 preferably returns to its resting position, thus returning lever 108 to its resting position and causing hatch 112 to close, wherein hatch 112 is preferably springfully urged shut via attached spring 116. Thereafter, control panel 150 preferably computer activates the movement of heat seal pad 98 along rails 95 and 97, wherein heat seal pad 98 preferably contacts heat seal strip 99 of mount 96, thus heat sealing the top portion of an ice-filled bag 102 positioned therebetween. Preferably during heat sealing of bag 102, tines 114 formed on edge 98*a* of heat seal pad 98 preferably assist in the separation of a filled bag of ice 102 from an unfilled bag 102 via mechanically perforating bags 102 from one another along perforations 105 of bags 102, as best illustrated in FIG. 6.

Upon separation of ice-filled bag 102 from the preceding unfilled bag 102, ice-filled bag 102 preferably drops into rotator 130, wherein rotator 130 is preferably positioned to receive ice-filled bag 102. Rotator 130 is preferably a basket-like container 132 having rotating motors 134 and 136 on opposing sides 132*a* and 132*b*, respectively, of container 132. Rotating motors 134 and 136 preferably function to rotate container 132 preferably 360 degrees, thus allowing ice-filled bag 102 to drop into storage 140 via aperture 142 formed in storage 140 and into container 132, wherein container 132 preferably rotatably returns to its resting position to receive another ice-filled bag 102 for subsequent deposit into storage 140. Although 360 degrees is preferred, any measure of rotational movement less than 360 degrees could be utilized, wherein the deposit of ice-filled bags into storage 140 could continue to be enabled. To ensure proper rotation of rotator 130, laser eyes 138 preferably flank rotator 130 and signal control panel 150 to remedy an improperly/incompletely rotated rotator 130.

Storage 140 is preferably any conventionally available freezer utilized to maintain freezing temperatures of bagged ice stored therein, wherein storage 140 preferably possesses an aperture 142 formed preferably on top surface 140*a* of storage 140 and preferably positioned/aligned above rotator 130 for receipt of bagged ice 102 therefrom. It is contemplated in an alternate embodiment that storage 140 could possesses an automated swiveling shifter positioned proximal aperture 142, wherein the shifter would swing from side to side as bagged ice 102 is deposited into storage 140, thus enabling bagged ice 102 to be equally distributed throughout storage 140.

Control panel 150 is preferably affixed to bagging assembly 40 and preferably is in electronic/computer control therewith. Specifically, control panel 150 preferably electronically/computer activates/controls all operations of icemaker assembly 20, bagging assembly 40, storage 140 and apparatus 10 in general. Moreover, upon encountering a problem/malfunction in the operations of apparatus 10, control panel 150 preferably troubleshoots and directs pre-programmed problem solving events to correct the problem, whereupon the inability of control panel 150 to correct the problem preferably results in control panel 150 sending a message and/or signal to the manufacturer or other appropriately authorized maintenance personnel for repair, and/or to store management depending upon the complexity of the problem. Control panel 150 preferably sends the signals via computer networking, modems and/or global networking systems and/or via any other known messaging/signaling technologies. Additionally, control panel 150 preferably signals store management regarding simple maintenance issues including, but not limited to, bag roll 100 replacement and/or replacement of sediment filters 25 and UV filters 27, wherein such signaling may be via audible beeps/buzzers, warning lights and/or other sensory mechanisms and/or known messaging/signaling technologies.

It is contemplated in an alternate embodiment that bagging assembly 40 of apparatus 10 could possess a plurality of bag rolls 100, wherein apparatus 10 could be further modified/altered to facilitate the simultaneous bagging of a plurality of bags of ice 102.

It is contemplated in an alternate embodiment that bagging assembly 40 could include a substantially continues roll of bags having side seams only, wherein user-programmable selection of bag size could be enabled, wherein heat sealing of two ends of the bag could be enabled, and wherein an automated cutting mechanism could be included to cut the newly sealed bag. Moreover, bagging assembly 40 could utilize two rolls of sealable plastic, wherein plastic from each said roll could form one side of the ice bag, wherein the sides and the bottom could be heat sealed to form the bag, and wherein the bag could be cut.

It is contemplated in an alternate embodiment that bagging assembly 40 could utilize continuous feed bags with zipper-type closure means incorporated thereon, wherein sealing of filled bags could be accomplished without the application of heat.

It is contemplated in an alternate embodiment that icemaker assembly 20, bagging assembly 40 and storage 140 of apparatus 10 could be situated adjacent one another and in adjacent communication with one another.

It is contemplated in an alternate embodiment that apparatus 10 could be manufactured without storage 140, wherein storage 140 would be replaced with a receptacle, such that a customer would utilize a keypad or the like to enter the numerical amount of bagged ice desired, and thereafter receive freshly bagged ice deposited into the receptacle by apparatus 10.

It is contemplated in an alternate embodiment that apparatus 10 could be equipped with a volumetric drum to further assist in the measurement and dispensing of a specified quantity of ice.

It is contemplated in an alternate embodiment that apparatus 10 could be equipped with multiple icemaker assemblies 20, multiple hoppers 40, multiple slider boxes 60 and multiple slider trays for the simultaneous bagging of multiple bags of ice 102.

It is contemplated in an alternate embodiment that apparatus 10 could be modified and/or altered to deposit ice-filled bags 102 through more than one aperture in storage 140, thus permitting ice-filled bags 102 to be evenly distributed within storage 140.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. An ice-bagging apparatus, comprising:

means for producing ice;

means for bagging the ice produced by said means for producing ice, wherein said means for bagging comprises at least one box slidably engaged with at least one tray, said at least one box adapted to receive the ice produced by said means for producing ice, and wherein said at least one tray is positioned at an angle relative to a ground surface; and, means for dispensing the bagged ice.

2. The ice-bagging apparatus of claim 1, wherein said means for producing ice is at least one icemaker.

3. The ice-bagging apparatus of claim 1, further comprising at least one hopper for collecting the produced ice and for funneling the collected ice to said means for bagging, wherein said at least one box is adapted to receive the collected ice from said at least one hopper, and wherein said at least one hopper further comprises at least one ice agitator.

4. The ice-bagging apparatus of claim 1, wherein said at least one box comprises at least one gravitationally encouraged drainage channel.

5. The ice-bagging apparatus of claim 1, wherein said at least one box moves relative to said at least one tray, wherein said movement results in the passage of ice through at least one aperture in said at least one box, through at least one aperture in said at least one tray, and thereafter, into at least one bag, said at least one bag received from said means for bagging via at least one roller conveyor and at least one bag roll.

6. The ice-bagging apparatus of claim 5, wherein said means for bagging further comprises at least one hatch positioned proximate to said at least one aperture in said at least one tray, wherein said at least one bag received from said means for bagging is positioned proximate to said at least one hatch and wherein said at least one hatch pivots to channel the ice falling from said at least one aperture of said at least one tray into said at least one bag.

7. The ice-bagging apparatus of claim 6, wherein said at least one bag is opened via at least one blower and wherein said at least one hatch prevents closure of said at least one bag during the filling thereof with ice.

8. The ice-bagging apparatus of claim 1, further comprising at least one sealer to seal at least one bag filled with ice.

9. The ice-bagging apparatus of claim 1, further comprising at least one rotator for receiving bagged ice from said means for bagging, said at least one rotator being at least one container rotatable via at least one motor.

10. The ice-bagging apparatus of claim 9, wherein said at least one rotator rotates via said at least one motor to deposit the bagged ice into said means for dispensing.

11. The ice-bagging apparatus of claim 10, wherein said means for dispensing is at least one thermally insulated unit.

12. The ice-bagging apparatus of claim 1, wherein said means for dispensing is at least one storage unit.

13. The ice-bagging apparatus of claim 1, wherein said means for dispensing is at least one vending machine.

14. The ice-bagging apparatus of claim 1, further comprising at least one control panel for computerized and electronic monitoring, controlling and operation of said apparatus.

15. The ice-bagging apparatus of claim 1, further comprising means for sensing operational parameters of said apparatus and for sensing utilization of a selected make and type of bag, said means for sensing selected from the group consisting of photoelectric eyes, laser technology, barcode technology, and combinations thereof.

16. An ice-bagging apparatus, comprising:

means for producing ice;

means for bagging the ice produced by said means for producing ice, wherein said means for bagging comprises at least one box slidably engaged with at least one tray, said at least one box adapted to receive the ice produced by said means for producing ice, and wherein said at least one tray is positioned at an angle relative to a ground surface;

means for dispensing bagged ice;

means for controlling operation of said apparatus; and, means for sensing operational parameters of said apparatus.

17. The ice-bagging apparatus of claim 16, wherein said means for producing ice is at least one icemaker.

18. The ice-bagging apparatus of claim 16, further comprising at least one hopper for collecting the produced ice and for funneling the collected ice to said means for bagging, wherein said at least one box is adapted to receive the collected ice from said at least one hopper, and wherein said at least one hopper further comprises at least one agitator.

19. The ice-bagging apparatus of claim 16, wherein said at least one box comprises at least one angled drainage channel.

20. The ice-bagging apparatus of claim 16, wherein said at least one box slidably moves relative to said at least one tray, and wherein such slidable movement of said at least one box results in the ice deposited therewithin passing through at least one aperture in said at least one box, through at least one aperture in said at least one tray, and thereafter, into at least one bag, said at least one bag fed from said means for bagging via at least one roller conveyor and supplied by at least one bag roll.

21. The ice-bagging apparatus of claim 20, wherein said means for bagging further comprises at least one hatch positioned to pivot and thus channel the ice falling from said at least one aperture of said at least one tray into said at least one bag.

22. The ice-bagging apparatus of claim 21, wherein said at least one bag is blown open prior to the filling of same with ice, and wherein said at least one hatch facilitates the deposit of ice into said at least one bag by holding said at least one bag in an open position.

23. The ice-bagging apparatus of claim 16, further comprising at least one heat sealer to heat-seal at least one bag filled with ice.

24. The ice-bagging apparatus of claim 16, further comprising at least one rotator for receiving bagged ice from said means for bagging, said at least one rotator being at least one motorized rotatable container.

25. The ice-bagging apparatus of claim 24, wherein said at least one rotator rotates via at least one motor and deposits the bagged ice into said means for dispensing.

26. The ice-bagging apparatus of claim 25, wherein said means for dispensing is at least one thermally insulated unit.

27. The ice-bagging apparatus of claim 16, wherein said means for dispensing is at least one storage unit.

28. The ice-bagging apparatus of claim 16, wherein said means for dispensing is at least one vending machine.

29. The ice-bagging apparatus of claim 16, wherein said means for controlling operation of said apparatus is at least one control panel for computerized and electronical monitoring, controlling and operation of said apparatus.

30. The ice-bagging apparatus of claim 16, wherein said means for sensing accurate and proper operation of said apparatus and for sensing utilization of a selected make and type of bag is selected from the group consisting of photoelectric eyes, laser technology, barcode technology, and combinations thereof.

31. An ice-bagging apparatus, comprising:

at least one icemaker;

at least one collecting mechanism for collecting ice produced by said at least one icemaker;

at least one bagging assembly for bagging the ice produced by said at least one icemaker, said at least one bagging assembly comprising at least one box slidably engaged with at least one tray, said at least one box adapted to receive the ice collected by said at least one collecting mechanism, and wherein said at least one tray is situated at an angle relative to a ground surface;

at least one storing unit for storing the ice bagged by said at least one bagging assembly;

at least one control panel for controlling operation of said apparatus; and, at least one sensing mechanism for sensing operation of said apparatus and for sensing bag parameters.

32. The ice-bagging apparatus of claim 31, wherein said at least one collecting mechanism is at least one hopper, said at least one hopper adapted to funnel ice into said at least one box, said at least one hopper further comprising at least one agitator for agitating ice deposited and collected therein.

33. The ice-bagging apparatus of claim 31, wherein said at least one box comprises at least one drainage channel for channeling melting ice and water away from solid ice deposited into said at least one box by said at least one hopper, and wherein said at least one tray assists in the drainage of the melting ice and the water from said at least one box as a result of said at least one tray being situated at an angle relative to the ground surface.

34. The ice-bagging apparatus of claim 31, wherein said at least one box slides over said at least one tray for depositing ice carried therewithin through at least one aperture formed through said at least one box, through at least one aperture formed through said at least one tray, and thereafter, into at least one bag, said at least one bag fed through said at least one bagging assembly via at least one roller conveyor and supplied by at least one bag roll.

35. The ice-bagging apparatus of claim 34, wherein said at least one bagging assembly further comprises at least one hatch positioned under said at least one aperture formed through said at least one tray, wherein said at least one bag to be filled with ice is fed through said at least one bagging assembly and positioned under said at least one hatch, said at least one hatch capable of pivoting downward to channel ice falling through said at least one aperture of said at least one tray into said at least one bag.

36. The ice-bagging apparatus of claim 35, wherein said at least one hatch physically holds open a mouth of said at least one bag to facilitate the deposit of ice therein, wherein the mouth of said at least one bag is initially opened via at least one blower.

37. The ice-bagging apparatus of claim 31, further comprising at least one heat sealer to heat-seal at least one bag filled with ice.

38. The ice-bagging apparatus of claim 31, further comprising at least one rotator for receiving bagged ice from said at least one bagging assembly, said at least one rotator being at least one container rotatable via at least one motor.

39. The ice-bagging apparatus of claim 38, wherein said at least one rotator rotates via said at least one motor to deposit the bagged ice into said at least one storing unit.

40. The ice-bagging apparatus of claim 39, wherein said at least one storing unit is at least one thermally insulated unit.

41. The ice-bagging apparatus of claim 31, wherein said at least one storing unit is at least one vending machine.

42. The ice-bagging apparatus of claim 31, wherein said at least one control panel for controlling operation of said apparatus allows computerized and electronical monitoring, controlling and operation of said apparatus.

43. The ice-bagging apparatus of claim 31, wherein said at least one sensing mechanism is selected from the group consisting of photoelectric eyes, laser technology, barcode technology, and combinations thereof.

* * * * *